US005890640A

United States Patent [19]

Thompson

[11] Patent Number: 5,890,640

[45] Date of Patent: Apr. 6, 1999

[54] INTERNAL FRAME PACK WITH LOAD-RESPONSIVE SPRING RODS

[75] Inventor: Jesse B. Thompson, Bozeman, Mont.

[73] Assignee: K-2 Corporation, Vashon, Wash.

[21] Appl. No.: 689,819

[22] Filed: Aug. 14, 1996

[51] Int. Cl.[6] ..... A45F 3/04; A45F 3/08; A45F 3/10

[52] U.S. Cl. ..... 224/630; 224/153; 224/631; 224/632; 224/633; 224/634; 224/635; 224/636; 224/643

[58] Field of Search ..... 224/630, 631, 224/632, 633, 634, 635, 636, 153, 580, 643

[56] References Cited

U.S. PATENT DOCUMENTS

| | | | |
|---|---|---|---|
| 3,734,366 | 5/1973 | Wood | 224/635 |
| 4,074,839 | 2/1978 | Wood et al. | 224/635 |
| 4,356,942 | 11/1982 | Hayes . | |
| 4,369,903 | 1/1983 | Wilkes | 224/635 |
| 4,420,103 | 12/1983 | Douglass | 224/153 |
| 5,005,744 | 4/1991 | Gleason . | |
| 5,240,159 | 8/1993 | Gregory | 224/643 |
| 5,292,043 | 3/1994 | McHale . | |
| 5,361,955 | 11/1994 | Gregory | 224/630 |
| 5,503,314 | 4/1996 | Fiscus | 224/634 |
| 5,704,530 | 1/1998 | Scherer | 224/632 |

*Primary Examiner*—David J. Walczak
*Assistant Examiner*—Timothy L. Maust
*Attorney, Agent, or Firm*—Christensen O'Connor; Johnson & Kindness PLLC

[57] ABSTRACT

An internal frame backpack (10) includes a pack (12) having an anterior side (14) that contacts a user's back, and left and right shoulder straps (10, 18) attached at an upper end to an upper portion (20) of the pack and at a lower end to left and right lower portions (44, 46) of the pack. The pack includes an internal frame formed from an elastomeric pad (24) integrated into the anterior side of the pack, and resilient left and right rods (26, 28) mounted within the pack and secured to the elastomeric pad. The resilient rods act as coil springs which support loads in the pack with a degree of flexibility that varies in response to the magnitude of the load.

24 Claims, 3 Drawing Sheets

INTERNAL FRAME PACK WITH LOAD-RESPONSIVE SPRING RODS

FIELD OF THE INVENTION

The present invention relates to packs for supporting loads on the backs of individuals, and more particularly, to packs with flexible internal frames.

BACKGROUND OF THE INVENTION

Conventional backpacks for hikers and others to carry loads typically utilize either a rigid tubular metal frame secured externally to a pack, or a frame having a limited degree of flexibility which is mounted internally within the pack. The frame serves the purpose of both supporting the load placed within the pack, and distributing the load to the user's hips and shoulders. External frame backpacks are typically well suited for use with heavier loads, but are often uncomfortable due to the rigidity of the frame.

Internal frame packs are designed to more closely hug and conform to the user's body, as compared to external frame packs, as is often desirable for stability for off-trail activities. Conventional internal frame packs include a padded back panel which rests against the wearer's back. A pocket is formed within the pack on the opposite side of the padded back panel, which receives a semi-rigid planar support sheet. The support sheet is typically formed from a sheet of plastic material or lightweight metal, such as aluminum. The support sheet may be contoured, sometimes on a customized basis, to follow the contour of the back and spine. The resulting frame formed by the pad and support sheet is typically more flexible than an external frame, because of the limited flexibility of the planar support sheet, the resilient cushioning of the back panel pad, and the typically less extensive vertical and horizontal span of the frame as compared to that of an external frame. Internal frame backpacks are typically more flexible and conform to the wearer's back to stabilize the load during active movement, but may not be as effective at distributing the load to the hips and shoulders as an external frame pack. Conventional internal frame packs may also undesirably concentrate the load in part on the lumbar region of the back.

A further limitation of conventional backpack frames is that differing loads require differing levels of support. A heavy load typically will require a very stiff frame, such as may be provided by external frame packs, or by some internal frame packs which have only a very limited degree of flexibility. A smaller load, however, may be well supported by a more flexible internal frame pack which is more comfortable to wear. Thus, an individual who at times carries loads of differing magnitude, such as for differing duration hikes, would optimally need at least two packs designed to meet the varying load conditions.

A still further limitation of conventional pack designs, particularly those which have a higher degree of stiffness and rigidity to carry heavier loads, is the inability of the pack to flex sufficiently to conform to a user's back as the user bends and twists during hiking. This results in the pack at times bearing uncomfortably on small portions of the back during bending and twisting movements, even in packs where the frame has been contoured to follow the profile back in the normal upright position.

SUMMARY OF THE INVENTION

The present invention provides a backpack for carrying a load on the back of a user. The backpack includes a pack defining an anterior side positionable against the back of the user. The backpack fiurer includes left and right shoulder straps, each connected at a first end to an upper portion of the pack and at a second end to left and right lower portions of the pack, respectively. The backpack further includes an integral frame, which includes an elastomeric pad incorporated into the anterior side of the pack. The frame also includes left and right resilient, elongate rods secured to the anterior side of the pack adjacent the elastomeric pad. The left and right rods extend from the respective left and right lower portions of the pack to the upper portion of the pack.

In a preferred embodiment of the invention, the left and right resilient, elongate rods are secured to the anterior side of the pack such that they bend arcuately under a preload. The rods each have a lower end which extends into the lower portion of the pack beyond the point of attachment to the second ends of the shoulder straps, and to a point of attachment of a corresponding end of a hip belt. The rods then extend upwardly to an upper end, which projects beyond the point of attachment of the first end of the corresponding shoulder strap. The resilient, elongate rods, in conjunction with the elastomeric pad, act to support and distribute the load to the backpack. The arcuately-bent, elongate rods act as pre-loaded coil springs to support the load, with the degree of flex of the rods being limited by the load which fills the backpack. The rods thus become stiffer, providing a less flexible frame, in response to heavier loads.

In a fiuther aspect of the present invention, the elastomeric pad includes a series of horizontally-disposed, elongate recesses formed in a planar surface of the pad. The recesses enable the pad to readily flex in the vertical direction without bunching as it bends along the recesses.

The present invention thus provides a resilient and responsive internal-framed backpack with flexibility characteristics that adjust according to the load applied. The frame of the pack is able to bend to conform to the user's back, distributes load to the shoulders and hips while avoiding distribution of excess load to the lumbar region of the user's back, and flexes both vertically and transversely to accommodate bending and twisting of the user's back and spine during movement. The pack is thus highly comfortable to wear and adaptable to differing usage conditions.

BRIEF DESCRIPTION OF THE DRAWINGS

The foregoing aspects and many of the attendant advantages of this invention will become better understood in view of the drawings, wherein.

DETAILED DESCRIPTION OF THE PREFERRED EMBODIMENT

Figure 1:
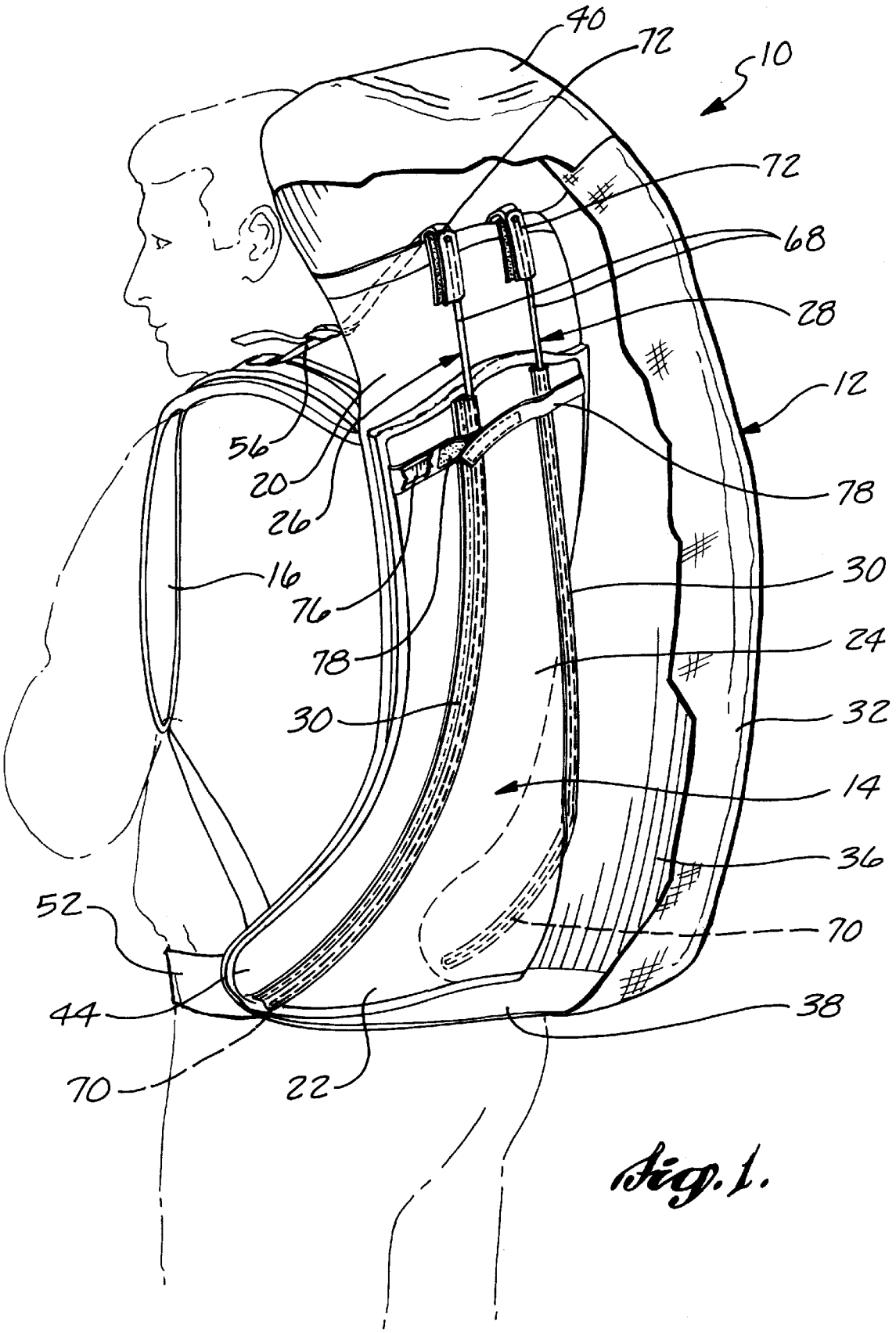
FIG. 1 provides a pictorial view of a pack constructed in accordance with the present invention worn on the back of a user shown in phantom, with a wall of the pack being broken away to show the internal frame construction.

A backpack 10 constructed in accordance with the present invention is illustrated in FIG. 1. The backpack 10 includes a sack-like pack 12 having an anterior side 14 that contacts the user's back when the backpack is worn. The pack further includes left and right shoulder straps 16 and 18 (FIG. 2) attached at an upper end to an upper portion 20 of the anterior side 14 and at a lower end to a lower portion 22 of the anterior side 14. The pack includes an integrated internal frame formed from an elastomeric pad 24 and left and right resilient rods 26 and 28. The pad 24 is integrated into the anterior side 14 of the pack 12. The left and right rods 26, 28 are mounted within the interior of the pack 12 within tubular fabric sleeves 30 secured to the elastomeric pad 24.

Figure 2:
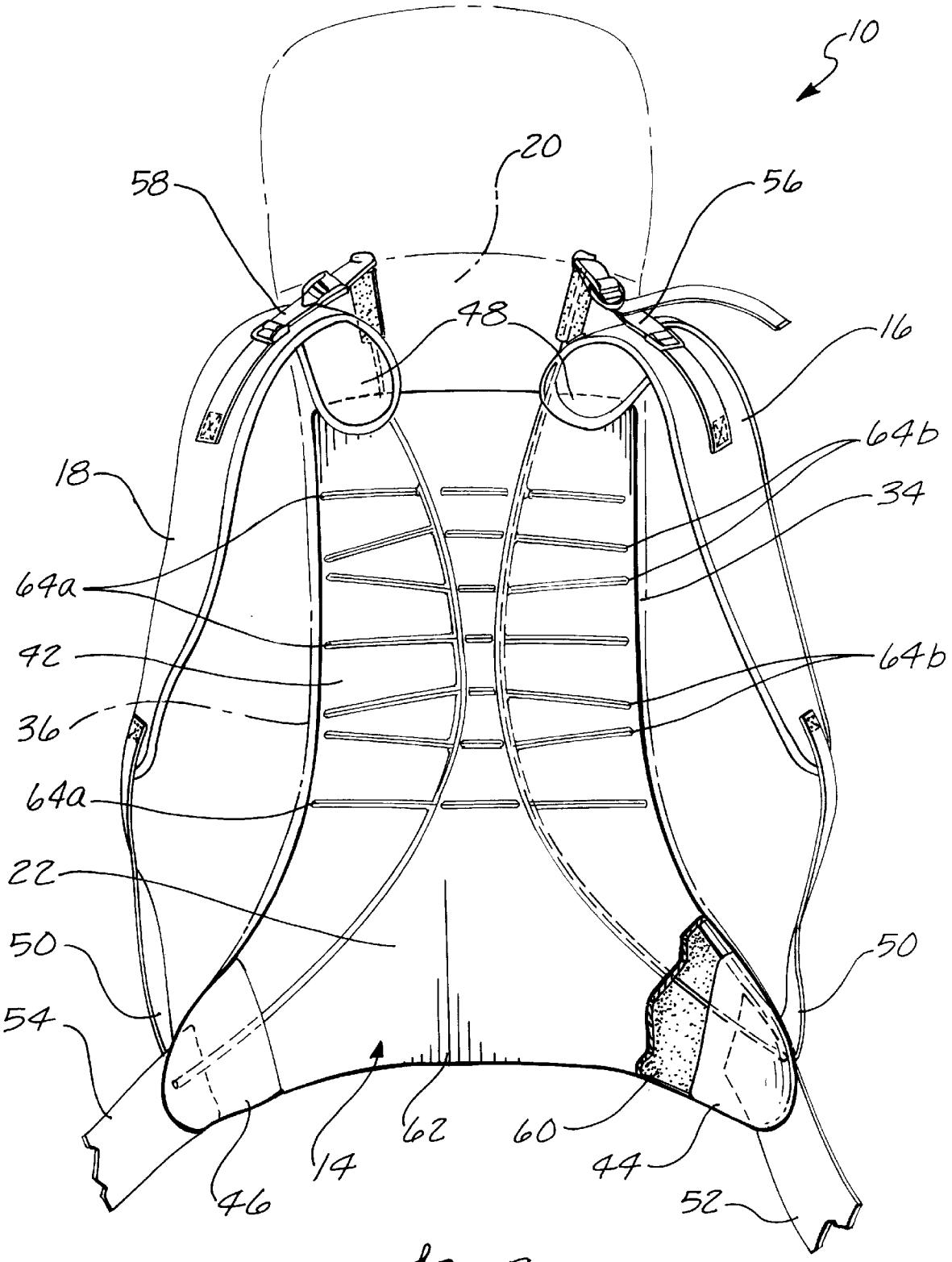
FIG. 2 is a front plan view of the anterior side of the pack of FIG. 1.

Attention is now directed to FIGS. 1 and 2 to describe the construction of the pack 12. The pack 12 is sewn from panels of wear-resistant fabric, such as nylon fabric, as is well known in the art. The pack 12 has the anterior side 14, a posterior side 32, and left and right sides 34 and 36, respectively. As used herein throughout, the term "anterior" is used to refer to the side of the pack facing the user when the pack is worn by the user, while the term "posterior" refers to the opposite side thereof. These sides define an overall tubular structure which is closed by a bottom wall 38 on the lower end and which defines an upper aperture for placement of articles into the pack. The upper aperture is covered by a closure 40 which is formed as a flap extending rearwardly from the upper portion 20 of the anterior side 14. The pack 40 may include various storage and load restraint features, as is well known to those of ordinary skill in the art.

Referring to the plan view of FIG. 2, the anterior side 14 of the pack has an elongate configuration centered about a longitudinal axis. The upper portion 20 of the anterior side of the pack 14 corresponds to the area of the pack 12 disposed behind the user's head when the pack is worn. The anterior side 14 also has an intermediate portion 42 which nestles against the wearer's upper back when the pack is worn, and the lower portion 22 which rests against the lumbar region of the back when the pack is worn. The lower portion 22 flares outwardly and downwardly on either side to form a left lower portion 44 and a right lower portion 46. When the pack is worn, the left and right lower portions 44 and 46 wrap partially around the user's hips in the anterior direction.

The left and right shoulder straps 16 and 18 each have an upper end 48 that is sewn or otherwise secured to the upper portion 20 of the anterior side 14 of the pack. A lower end 50 of each of the left and right shoulder straps 16, 18 is sewn or otherwise secured to the outermost tip of the left and right lower portions 44, 46, respectively, of the anterior side 14 of the pack 12.

The pack also includes a hip strap which has a left side 52 that is sewn or otherwise secured to the lower left portion 44, and a right side 54 that is sewn or otherwise secured to the right lower portion 46. The left and right sides 52, 54 of the hip strap are secured together in front of the user when the backpack is worn by a buckle or catch of conventional design (not shown).

The backpack 10 also includes left and right load lift straps 56 and 58, respectively. The left and right load lift straps 56, 58 are connectable between the left and right shoulder strap 16, 18, and the upper portion 20 of the anterior side 14 of the pack 12, as shown in FIGS. 1 and 2. Each of the left and right load lift straps 56, 58 has a first end which is sewn or otherwise secured to the corresponding left or right shoulder strap 16, 18, at a point which would correspond to the anterior side of the shoulder of a user wearing the pack. The opposite end of the left and right load lift straps 56, 58 is sewn or otherwise secured to the upper portion 20 of the anterior side 14 of the pack, at a space elevated above the point of securement of the upper ends 48 of the left and right shoulder strap 16, 18. The left and right load lift straps 56, 58 each include a conventional buckle and length adjusters. The left and right load lift straps 56, 58 can be connected and adjusted in length to transfer load in the upper portion of the backpack 10 forwardly, to stabilize the pack and aid in distribution of the weight of the pack. The load lift straps 56, 58 operate in conjunction with the left and right resilient rods 26, 28 of the internal frame, as shall be described subsequently.

As noted previously, the pack 12 includes an internal frame formed from an elastomeric pad 24 and left and right resilient rods 26, 28. Referring still to FIGS. 1 and 2, the elastomeric pad 24 covers the entire lower portion 22 and intermediate portion 42 of the anterior side of the pack 14, as well as a segment of the upper portion 20 of the anterior side of the pack 14. The elastomeric pad 24 thus extends downwardly all the way into the outer tips of the left and right lower portions 44 and 46 of the anterior side 14, and spans the entire width of the anterior side 14. At its upper end, the elastomeric pad 24 terminates just above the point of attachment of the upper ends 48 of the left and right shoulder straps 16, 18, but below the point of attachment of the left and right load lift straps 56, 58 to the pack 12.

The elastomeric pad 24 is a flexible pad which provides cushioning to the back of the user, and which also serves to stiffen the anterior side 14 of the pack 12. The term "stiffen" is used to convey that the elastomeric pad 24 makes the anterior side 14 of the pack 12 self-supporting, while still permitting the anterior side 14 of the pack to be flexible. The elastomeric pad 24 includes an internal contoured elastomeric sheet 60, which is preferably formed from a resilient material. Suitable materials include open-celled foamed polymers, such as urethane foam, which provide support and resilient flexibility while also permitting breathability through the anterior side 14. The elastomeric pad 24 is completed by laminating the elastomeric sheet 60 between fabric skins 62 on both the interior and the exterior sides of the elastomeric sheet 60 for strength and wear resistance. The fabric skins 62 are suitably adhered in place using an adhesive, or alternately may be molded in place over the elastomeric sheet 60.

The elastomeric pad 24 preferably is formed from a unitary, one-pieced elastomeric sheet 60, and serves as one of the panels which defines the anterior of the pack. The interior and exterior fabric skins 62 of the elastomeric pad 24 are sewn about the perimeter of the elastomeric sheet 60 to the left side 34, right side 36, and bottom wall 38 of the pack 12.

In order to aid in bending of the elastomeric pad 24 while the backpack 10 is worn by a user, the elastomeric pad 24 includes a plurality of generally horizontally disposed elongate fold recesses 64. The fold recesses 64 are formed into the anterior side of the elastomeric pad 24, i.e., the side of the elastomeric pad 24 facing the user when the pack is worn. Each of the fold recesses 64 has a groove-like configuration, which has a "V" shaped cross-sectional profile, and spans the entire transverse width of the anterior side 14 of the pack 12. The fold recesses 64 are arrayed in a vertically spaced sequence along the intermediate portion 42 of the anterior side 14. The fold recesses 64 are arranged as an array of three straight fold recesses 64a interspersed with two pairs of angled fold recesses 64*b*.

Referring to FIG. 2, the lowermost fold recess 64*a*, which will be disposed above the lumbar region of the back when the pack 12 is worn, follows a straight horizontal path. Likewise, an uppermost fold recess 64*a*, disposed below the point of attachment of the left and right shoulder straps 16, 18, and an intermediate fold recess 64*a* disposed midway therebetween, also each follow a straight horizontal path. In between each adjacent pair of straight fold recesses 64*a* are a pair of angled recesses 64*b*. Each angled fold recess 64*b* has a horizontal center segment and left and right angled segments. The angled segments of each angled fold recess 64*b* extends from the center segment, at a slight angle relative to horizontal, towards the left and right edges of the anterior side 14. Specifically, a first pair of angled fold recesses 64*b* is disposed between the lowermost and intermediate straight fold recess 64*a*. The uppermost angled fold recess 64*b* in this pair includes outer segments which veer slightly downwardly from horizontal, while the corresponding angled fold recess 64*b* immediately thereunder includes outer segments which veer slightly upwardly from horizontal. A similar pair of angled fold recesses 64*b* is disposed between the uppermost straight fold recess 64*a* and the intermediate fold recess 64*a*.

This arrangement of fold recesses 64 permits the elastomeric pad 24 to more readily bend to conform to a user's back. Because of the reduced thickness of the elastomeric pad 24 at these fold recesses 64, the pack is able to fold easily at these points without bunching, providing the frame of the backpack 10 with a higher degree of flexibility.

The elastomeric pad 24 also includes a pair of elongate arcuate recesses 66 formed in the anterior surface of the elastomeric pad 24. The arcuate recesses 66 are disposed generally vertically and are aligned with and follow the path scribed by the left and right resilient rods 26 and 28. Specifically, each arcuate recess 66 extends from a corresponding left or right lower portion 44, 46 inwardly towards the intermediate portion 42 of the anterior side 14, and then extends back outwardly towards the point of attachments of the upper ends 48 of the left and right shoulder straps 16, 18. Each arcuate recess 66 thus follows a generally parabolic path, approaching each other in the intermediate portion 42 of the anterior side 14, and being spaced further apart from each other in the upper portion 20 and lower portions 22 of the anterior side 14. The arcuate recesses 66 cut across the fold recesses 64, and are deeper than the fold recesses 64. The purpose of the arcuate recesses 66 is to receive the left and right resilient rods 26, 28 when the pack 12 is fully loaded, for greater comfort.

Referring now to FIG. 1, each of the left and right resilient rods 26, 28 acts as a preloaded, elongated bend of a coil spring which supports and distributes the load of the pack 12, in conjunction with the elastomeric pad 24. The resilient rods 26, 28 are formed from a resilient, semi-rigid material. Suitable materials include fiber reinforced thermoplastic or thermosetting polymers, such as glass fiber reinforced polyester or carbon fiber reinforced epoxy, by way of non-limiting examples. Each of the resilient rods 26, 28 is straight in the unrestrained configuration. In the preferred embodiment of the invention, each of the rods 26, 28 has a circular cross-sectional profile, but other configurations of elongate members could alternately be employed. During installation into the pack 12, the resilient rods 26, 28 are forced into an arcuate, bent configuration, thereby applying a preload flexural stress to the rods 26, 28. Each of the rods 26, 28 has an upper end 68 and a lower end 70. A short length of elastomeric sleeve (not shown) having a closed end is preferably installed over the upper end 68 and the lower end 70 of each resilient rod 26, 28 to prevent the ends of the rods from causing wear of the fabric pack materials.

Each of the left and right resilient rods 26, 28 is received within the interior of the pack 12, and is secured to the posterior surface of the anterior side 14 of the pack 12 within corresponding fabric sleeves 30. Each fabric sleeve 30 has an elongate tubular configuration, and is sewn to the posterior skin 62 of the elastomeric pad 24. The sleeves 30 are sewn along an arcuate path, corresponding to that previously described for the arcuate recesses 66. The left and right resilient rods 26, 28 are installed by inserting the lower end 70 of each resilient rod 26, 28 into a corresponding sleeve 30 and sliding the rod downwardly. As each resilient rod 26, 28 is inserted into the sleeve 30, it is forced to bend along the path of the sleeve 30. Each resilient rod 26, 28 is fully inserted such that the lower end 70 of the rod extends into the outermost tip of the corresponding left or right lower portion 44, 46 of the anterior side 14 of the pack. The lower end 70 of the rod 26, 28 thus extends fully to the point of attachment of the lower ends 50 of the left and right shoulder straps 16, 18, and to the point of attachment of the left and right sides 52, 54 of the hip strap.

The upper end 68 of each resilient rod 26, 28 projects out of the upper end of the corresponding sleeve 30, above the upper edge of the elastomeric pad 24, and the point of attachment of the upper ends 48 of the left and right shoulder straps 16, 18. The resilient rods 26, 28 are maintained in this installed configuration by tubular fasteners 72. Each tubular fastener 72 is configured as a fabric tube which has a lower portion that is sewn onto the interior of the upper portion 20 of the anterior side 14 of the pack 12. An upper portion of the tubular fastener 72 remains free, and can be slid onto the exposed upper end 68 of the corresponding rod 26, 28. As this tubular fastener 72 is slid over the upper end 68 of the rod, the tubular fastener 72 is folded in half over top of itself. The surfaces of the tubular fastener 72 that are folded against each other are provided with mating hook and loop fastener strips, which secure the tubular fastener 72 in this folded configuration over the received upper end 68 of the corresponding resilient rod 26, 28. The resilient rods 26, 28 are thus secured in this installed, preloaded configuration. To remove the resilient rods 26, 28, the tubular fasteners 72 are pulled outwardly to break the hook and loop engagement, and are then pulled off of the upper ends 68 of the resilient rods 26, 28. The resilient rods 26, 28 can then be removed, allowing the replacement of these rods with rods of differing diameter or flexibility characteristics. Thus, the resilient rods 26, 28 can be replaced with rods having higher or lower spring constants to adjust the stiffness of the backpack 10.

Referring to FIG. 2, when the backpack 10 is not being worn, each of the left and right rods 26, 28 follows a two-dimensional, arcuate path. Referring to FIG. 1, when the backpack 12 is worn by a user, the lower ends 70 of the rods 26, 28 are pulled in the anterior direction to wrap around the wearer's hips by the hip straps 52, 54. In this loaded, in-use configuration, the resilient rods 26, 28 trace a three-dimensional path, bending out of the nominal, relaxed plane of the anterior side 14. The load lift straps 56, 58 can also be connected and tightened to pull the upper ends 68 of the resilient rods 26, 28 in the anterior direction to finther bend and conform the backpack 10 to the user's body.

Attention is now directed to FIG. 1 to complete the description of the frame of the pack 12. The installed resilient rods 26, 28 are spaced apart from each other along their lengths, with the upper ends 68 and lower ends 70 being spaced apart further than an intermediate portion of the rods, and with the lower ends 70 of the rods being spaced apart a greater extent than the upper ends 68 of the rods. The resilient rods 26, 28 are maintained in this spaced relationship in part by a transverse frame member 76. The transverse frame member 76 is preferably formed from a rigid material, such as a reinforced thermosetting material, and has a flat, elongate bar configuration. The transverse frame member 76 is installed on the inside of the pack 12, and is secured to the posterior surface of the upper portion 20 of the anterior side 14 of the pack 12. The ends of the transverse frame member 76 are slid into tubular sleeves 78 which are sewn to the posterior surface of the anterior side 14 of the pack 12. The sleeves 78 are provided with extension flaps which extend towards and overlap each other. Mating strips of hook and loop fasteners are provided on the overlapping surfaces of these extension flaps, which permit the sleeves 78 to be secured together to retain the transverse frame member 76 in place. In addition to maintaining the rods 26, 28 in a spaced disposition, the transverse frame member 76 aids in transmitting loads imposed on the left and right rods 26, 28 laterally across the width of the pack 12.

The configuration of the left and right resilient rods 26, 28 as three-dimensionally bent coil springs provides a load-responsive aspect of the frame of the present invention. Specifically, when the pack is worn by a user, the left and right sides 52, 54 of the hip strap are pulled forwardly for securement. This results in bending of the left and right resilient rods 26, 28, and an intermediate portion of the rods tends to bow inwardly into the interior of the pack. However, when the pack is fully loaded, the left and right rods 26, 28 are physically constrained in the extent in which they are able to bend inwardly into the interior of the pack. This then provides for a stiffer pack for heavier load conditions. Thus, the ability of the pack to flex on the user's back varies in response to the load volume and rigidity, which is often related to the weight of the load.

The flexible frame provided by the resilient rods 26, 28, transverse frame member 76 and elastomeric pad 24 including fold recesses 64 and arcuate recesses 66 provides for a highly flexible and adaptable frame. The frame readily bends and flexes with the user's back as the user bends and twists his or her upper body while the pack is carried.

Figure 3:
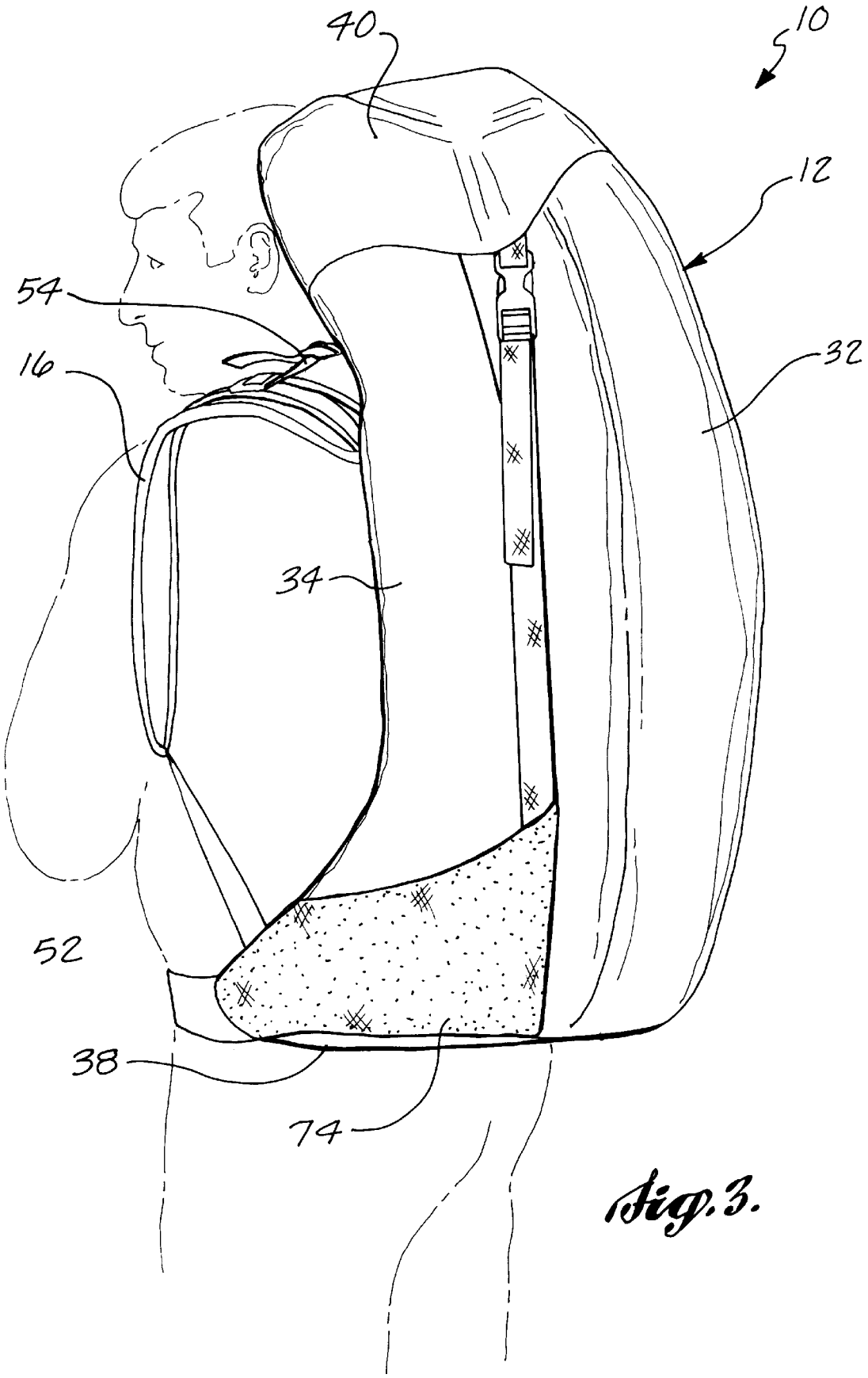
FIG. 3 is a pictorial view of the pack of the present invention worn on the back of a user shown in phantom.

Referring to FIG. 3, the backpack 12 includes a feature which permits this three-dimensional bending of the resilient rods 26, 28 even when the pack 12 is fully loaded. Specifically, each of the left and right sides 34, 36 of the pack 12 includes a unidirectional-stretchable fabric panel 74. The fabric panel 74 on each side of the pack 12 makes up a lower portion of the left or right side 34, 36, extending from the posterior side 32 of the pack 12 forwardly to the anterior side 14, just above the bottom wall 38 of the pack 12. Each fabric panel 74 is sewn about its perimeter to the other materials which form the pack 12. The fabric panels 74 are woven from elastomeric threads which run in a first direction and non-elastomeric threads which are woven in an opposite, transverse direction. Specifically, the elastomeric threads are oriented generally horizontally, allowing the left and right sides 34, 36 of the pack 12 to stretch in the direction extending from the posterior side 32 of the pack towards the anterior side 14 of the pack. This thus allows the left and right sides 34, 36 of the pack to stretch during connection of the left and right sides 52, 54 of the hip strap as the left and right lower portions 44, 46 of the anterior side 14 of the pack 12 are wrapped around the wearer's hips. Conversely, the non-stretchability of the unidirectional fabric panels 74 in the vertical direction prevents loads within the pack from causing the fabric panels 74 to sag. Suitable unidirectional-stretchable fabric materials are available under the trade name of VECTORED SPANDEX™, which is a weave of nylon threads and Lycra™ elastic threads.

As previously described, the pack 10 includes load lift straps 56, 58. These load lift straps can be connected and adjusted to work in conjunction with the left and right resilient rods 26, 28. The upper ends 68 of the left and right rods 26, 28 extend upwardly above the point of attachment of the upper ends 48 of the left and right shoulder straps 16, 18. The upper ends of the load lift straps 56, 58 are secured to the anterior side 14 of the pack 12 adjacent the upper ends 68 of the resilient rods 26, 28. Attaching and tightening the load lift straps 56, 58 thus ties the anterior shoulder segments of the left and right shoulder straps 16, 18 to the left and right rods 26, 28 to aid in transfer of load to the shoulders, and to stabilize the load.

While the preferred embodiment of the pack 10 has been described above utilizing two resilient rods 26, 28, it should be readily apparent that other configurations could be employed. Thus, for a greater degree of stiffness, it may be desired to use additional elongate rods in addition to the left and right resilient rods 26, 28. Also, rather than being formed as separate left an right rods 26, 28, the left and right rods could be provided by parallel legs of a single U-shaped formed rod.

While the preferred embodiment of the invention has been illustrated and described, it will be apparent that various changes can be made therein without departing from the spirit and scope of the invention.

The embodiments of the invention in which an exclusive property or privilege is claimed are defined as follow:

1. A backpack for carrying a load on the back of a user, comprising:

a pack defining an anterior side positionable against the back of the user;

left and right shoulder straps, each connectable at a first end to an upper portion of the pack and at a second end to left and right lower portions of the pack, respectively; and an integral frame comprising:

an elastomeric pad incorporated into the anterior side of the pack; and left and right resilient elongate rods tiat are independent and laterally spaced at least at one end thereof secured to the anterior side of the pack adjacent the elastomeric pad, the left and right rods extending from the respective left and right lower portions of the pack to the upper portion of the pack, wherein each rod has a longitudinal axis which resiliently flexes along a three-dimensional path when the pack carries a load and is worn by the user at least a portion of each rod flexing indenywdently of the other rod.

2. The backpack of claim 1, wherein the rods have lower ends and upper ends, the lower ends of the left and right rods being spaced apart horizontally to a greater extent than the upper ends.

3. The backpack of claim 2, wherein the backpack further comprises a hip belt having a first end secured to the left lower portion of the pack and a right end secured to the right lower portion of the pack, wherein the left and right rods extend along the left and right lower portions of the pack to the corresponding secured ends of the hip belt.

4. The backpack of claim 3, wherein the left and right rods extend within the upper portion of the pack to at least a point of connection of the corresponding first end of the left and right shoulder straps.

5. The backpack of claim 3, wherein the pack includes left and right lower fabric panels incorporated into the left and right lower portions of the pack adjacent the lower ends of the left and right rods, the fabric panels being resiliently stretchable in a first direction to permit tensioning of the hip belt when the pack is fully loaded and having a lesser degree of stretchability in a second direction transverse to the first direction.

6. The backpack of claim 2, wherein each of the rods defines an arcuate bend between the lower end and the upper end.

7. The backpack of claim 6, wherein the upper ends of the left and right rods are spaced apart horizontally, each rod having an intermediate portion, the intermediate portions of the left and right rods being spaced apart to a lesser extent than the upper ends and lower ends of the rods.

8. The backpack of claim 6, wherein the elastomeric pad includes first and second elongate arcuate recesses defined within the elastomeric pad adjacent the left and right rods, respectively.

9. The backpack of claim 6, wherein the bend in the rods induces a preload stress in the rods.

10. The backpack of claim 1, wherein the left and right rods are disposed within the frame to flex an extent responsive to the degree of loading of the pack.

11. The backpack of claim 10, wherein each of the left and right rods extend from at least a point of connection of the second ends of the left and right shoulder straps to at least a point of connection of the first ends of the left and right shoulder straps.

12. The backpack of claim 1, wherein the elastomeric pad defines a plurality of horizontally disposed elongate recesses defined therein to facilitate flexing of the elastomeric pad in a vertical direction.

13. The backpack of claim 12 further comprising at least one vertically disposed elongate recess defined in the inner or outer surface of the elastomeric pad.

14. The backpack of claim 1, wherein each rod has an upper end which extends within the upper portion of the pack beyond a point of connection of the first end of the corresponding left and right shoulder straps.

15. The backpack of claim 14, further comprising left and right load-lifting straps, each of the left and right load-lifting straps having a first end connectable to a corresponding one of the left and right shoulder straps at a point spaced from the point of connection of the shoulder strap to the pack and a second end connectable to the upper portion of the pack adjacent the upper end of the corresponding left or right rod.

16. The backpack of claim 1, wherein the left and right rods are mounted within an interior of the pack within fabric fasteners.

17. The backpack of claim 16, wherein the fabric fasteners are selectively releasable to allow removal and replacement of the left and right rods.

18. The backpack of claim 1, wherein the left and right rods are preloaded in flexural tension.

19. The backpack of claim 1, wherein the frame further comprises a transverse frame member connected to and spanning between the left and right rods.

20. A backpack for carrying a load on the back of a user, comprising:

a pack defining an anterior side positionable against the back of the user;

left and right shoulder straps, each connected at a first end to an upper portion of the pack , and at a second end to a lower portion of the pack; and an integral frame comprising:

a flexible pad incorporated into the anterior side of the pack; and a plurality of resilient elongate rods tat are independent and laterally spaced at least at one end thereof secured to the anterior side of the pack adjacent the flexible pad and extending from the lower portion to the upper portion of the pack and disposed to closely conform to the contour of a user's back, at least a portion of each rod flexing in dependently of the other rod.

21. A backpack for carrying a load on the back of a user, comprising:

a pack defining an anterior side positionable against the back of the user;

left and right shoulder straps each connected at a first end to an upper portion of the pack and at a second end to left and right lower portions of the pack, respectively; and an integral frame comprising:

an elastomeric pad incorporated into the anterior side of the pack, wherein the elastomeric pad defines at least one horizontally disposed elongate recess defined in one of an inner or outer planar surface of the elastomeric pad to facilitate bending of the elastomeric pad along the recess; and semi-rigid support means secured to the anterior side of the pack for providing a predetermined degree of semi-rigidity to the anterior side of the pack-, the support means comprising resilient elongate rods that are independent and laterally spaced at least at one end thereof, at least a portion of each rod flexing independently of the other rod wherein the support means resiliently flexes along a three-dimensional path when the pack carries a load and is worn by a user.

22. The backpack of claim 21, wherein the elastomeric pad defines a plurality of sequentially-spaced, horizontally disposed elongate recesses.

23. The backpack of claim 22, wherein the elastomeric pad further defines at least one vertically-oriented, elongate recess.

24. A backpack for carrying a load on the back of a user, comprising:

a pack defining an anterior side positionable against the back of the user;

left and right shoulder straps, each connectable at a first end to an upper portion of the pack and at a second end to left and right lower portions of the pack, respectively; and an integral frame comprising;

an elastomeric pad incorporated into the anterior side of the pack; and left and right resilient elongate rods that are independent and laterally spaced at least at one end thereof secured to the anterior side of the pack adjacent the elastomeric pad, the left end and right rods extending from the respective left and right lower portions of the pack to the upper portion of the pack, wherein the elongate rods are received at least partially along their lengths within corresponding flexible tubular sleeves secured to the elastomeric pad, at least a portion of each rod flexing independently of the other rod.

* * * * *

UNITED STATES PATENT AND TRADEMARK OFFICE

CERTIFICATE OF CORRECTION

PATENT NO. : 5,890,640
DATED : April 6, 1999
INVENTOR(S) : J.B. Thompson

It is certified that error appears in the above-identified patent and that said Letters Patent is hereby corrected as shown below:

| COLUMN | LINE | |
|---|---|---|
| Pg. 1, col. 2 | Attorney, Agent, or Firm | After "O'Connor" delete ";" |
| 8 (Claim 1, | 35 line 12) | "tiat" should read --that-- |
| 8 (Claim 1, | 43 line 20) | After "user" insert --,-- |
| 8 (Claim 1, | 44 line 21) | "indenywdently" should read --independently-- |
| 9 (Claim 13, | 27 line 1) | After "of claim 12" insert --,-- |
| 9 (Claim 20, | 57 line 6) | "pack , and" should read --pack and-- |
| 9 (Claim 20, | 62 line 11) | "tat" should read --that-- |
| 10 (Claim 20, | 5 line 17) | "in dependently" should read --independently-- |

UNITED STATES PATENT AND TRADEMARK OFFICE

CERTIFICATE OF CORRECTION

PATENT NO. : 5,890,640
DATED : April 6, 1999
INVENTOR(S) : J.B. Thompson

It is certified that error appears in the above-identified patent and that said Letters Patent is hereby corrected as shown below:

| COLUMN | LINE | |
|---|---|---|
| 10 (Claim 21, line 18) | 26 | "pack-," should read --pack,-- |

Signed and Sealed this

Twenty-sixth Day of October, 1999

*Attest:*

Q. TODD DICKINSON

*Attesting Officer*

*Acting Commissioner of Patents and Trademarks*